US008665169B2

(12) United States Patent
Yun et al.

(10) Patent No.: US 8,665,169 B2
(45) Date of Patent: Mar. 4, 2014

(54) MONOPOLE ANTENNA

(75) Inventors: Je-Hoon Yun, Daejon (KR); Soon-Young Eom, Daejon (KR); Joung-Myoun Kim, Daejon (KR); Yong-Hee Cho, Daejon (KR); Young-Kwon Hahm, Daejon (KR); Dae-Young Kim, Chungbuk (KR); Soon-Ik Jeon, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 1005 days.

(21) Appl. No.: 12/447,257

(22) PCT Filed: Oct. 26, 2007

(86) PCT No.: PCT/KR2007/005329

§ 371 (c)(1),
(2), (4) Date: Dec. 11, 2009

(87) PCT Pub. No.: WO2008/051055

PCT Pub. Date: May 2, 2008

(65) Prior Publication Data

US 2010/0085267 A1 Apr. 8, 2010

(30) Foreign Application Priority Data

Oct. 26, 2006 (KR) ..... 10-2006-0104712

(51) Int. Cl.
*H01Q 9/04* (2006.01)

(52) U.S. Cl.
USPC ..... 343/791; 343/747; 343/792; 343/802; 343/895

(58) Field of Classification Search
USPC ..... 343/791
See application file for complete search history.

(56) References Cited

U.S. PATENT DOCUMENTS

| | | | | |
|---|---|---|---|---|
| 4,442,438 | A * | 4/1984 | Siwiak et al. | 343/792 |
| 5,057,106 | A * | 10/1991 | Kasevich et al. | 606/33 |
| 5,231,412 | A | 7/1993 | Eberhardt et al. | |
| 5,661,495 | A | 8/1997 | Saldell | |
| 6,054,966 | A * | 4/2000 | Haapala | 343/895 |
| 6,963,313 | B2 * | 11/2005 | Du | 343/790 |

FOREIGN PATENT DOCUMENTS

| | | |
|---|---|---|
| JP | 06-303024 | 10/1994 |
| JP | 2002-314316 | 10/2002 |
| JP | 2003-87031 | 3/2003 |

(Continued)

OTHER PUBLICATIONS

K. Ito et al., "Minimally Invasive Thermal Therapy for Cancer Treatment by Using Thin Coaxial Antennas", 2001 Proceeding of the 23rd Annual EMBS International Conference, pp. 3314-3317, Oct. 2001.

(Continued)

*Primary Examiner* — Jerome Jackson, Jr.
*Assistant Examiner* — Hai Tran
(74) *Attorney, Agent, or Firm* — Rabin & Berdo, P.C.

(57) ABSTRACT

Provided is a small monopole antenna, which can generate a plurality of resonant frequencies, have a high antenna efficiency, and be easily installed. The antenna includes a first antenna element formed of a coaxial cable; a second antenna element sealing the first antenna element and sharing a feed point with the first antenna element; and a feeder cable for feeding electric power to the feed point. This antenna is applied as a small antenna.

23 Claims, 19 Drawing Sheets

(56) References Cited

FOREIGN PATENT DOCUMENTS

| | | |
|---|---|---|
| JP | 2004-328364 | 11/2004 |
| KR | 1996-0016005 | 5/1996 |
| KR | 2001-0084494 | 9/2001 |
| KR | 10-2004-0100057 A | 12/2004 |
| KR | 10-2005-0108879 A | 11/2005 |

OTHER PUBLICATIONS

T. Tsukiji et al., "Double-folded monopole antenna using parallel line or coaxial cable", IEEE Proc.-Microw. Antennas Propag., vol. 149, No. 1, pp. 17-20, Feb. 2002.

* cited by examiner 11-1

11-2

16-1 16-2

19-1 19-2 19-3

MONOPOLE ANTENNA

TECHNICAL FIELD

The present invention relates to a small-sized monopole antenna; and, more particularly, to a small-sized monopole antenna that includes an external antenna or an antenna installed inside a dielectric substance. Specifically, an end of the antenna is shorted or opened and thus a plurality of resonant frequencies are generated. The small-sized monopole antenna has high antenna efficiency and is easy to install in a terminal.

This work was supported by the IT R&D program of MIC/IITA ["Development of Antenna Measurement System Technology"].

BACKGROUND ART

Audio, video and broadcasting services using ultrahigh frequency (UHF) band were launched subsequent to digital television (DTV). Examples of the audio, video and broadcasting services using UHF band include Terrestrial Digital Multimedia Broadcasting (T-DMB), Digital Video Broadcast-Handheld (DVB-H), Satellite Digital Multimedia Broadcasting, and Digital Audio Broadcasting (DAB). A wavelength of an available frequency band for these services is longer than a length of a mobile phone. For example, when a λ/4 monopole antenna is used, an antenna length is much larger than that of a mobile phone. For example, in case of a T-DMB, an antennal length is about 40 cm. Thus, such an antenna is inconvenient in use and it is difficult to install the antenna inside a mobile phone.

To solve this problem, many attempts have been made to develop small-sized antennas implemented with internal antennas or stubby antennas.

For miniaturization of internal antennas such as a planar inverted F antenna, a microstrip patch antenna, or a dielectric antenna, their electrical length is reduced by using a dielectric material or changing a shape of an antenna element. However, since the internal antennas are mounted only in printed circuit board (PCB) circuits, it is difficult to maintain an omni-directional radiation pattern of a vertically polarized wave due to the PCB circuit vertically mounted in a mobile phone.

Further, an antenna miniaturization technique that adds a gap capacitor to a conventional loop antenna has a problem in that it cannot maintain high antenna efficiency because it does not use a resonance characteristic of an antenna in itself.

A monopole antenna is an antenna that resonates with a length of λ/4, not λ/2, due to an image effect of an antenna ground plane. Examples of the monopole antenna include a whip antenna, a helical antenna, a sleeve antenna, and an N-type antenna. Most of them are external type antennas and have a length of λ/4.

FIG. 1 illustrates a structure of a conventional monopole antenna.

Referring to FIG. 1, the conventional monopole antenna includes an antenna wire 101, a feeder cable 103, and a ground plane 105.

A length from the ground plane 105 to an end of the antenna wire 101 is L. The feeder cable 103 feeds electric power to the antenna wire 101.

A specific frequency at which the length L of the antenna wire 101 is equal to λ/4 is a resonant frequency.

A large current is generated within the antenna wire 101 at the resonant frequency, and the current induces an electric field and a magnetic field, thus making the antenna wire 101 serve as an antenna.

However, as the resonant frequency decreases, the length of the antenna wire must increase.

FIG. 2 illustrates a structure of a conventional helical monopole antenna embedded in a dielectric substance.

Referring to FIG. 2, the conventional helical monopole antenna includes an antenna wire 201, a feeder cable 203, a ground plane 205, and a dielectric substance 207.

The antenna wire 201 is embedded in the dielectric substance 207 and has a predetermined length from the ground plane 205. The feeder cable 203 feeds electric power to the antenna wire 201.

Like in FIG. 1, a specific frequency at which the length of the antenna wire 201 is equal to λ/4 is a resonant frequency. A large current is generated within the antenna wire 201 at the resonant frequency, and the current induces an electric field and a magnetic field, thus making the antenna wire 201 serve as an antenna.

However, as the resonant frequency decreases, the length of the antenna wire 201 must increase.

Therefore, there is a need for a small-sized monopole antenna with length less than λ/4, which can generate a plurality of resonant frequencies and maintain an antenna length constantly.

To reduce the size of the monopole antennas described above, a new technique was proposed which adds an inductance element such as a helical antenna to a disk monopole antenna. This technique can maintain a broadband characteristic, but an installation of an antenna is complicated. Further, since the width and height of the antenna are large, the antenna is difficult to embed in the mobile phone.

Accordingly, there is a need for small-sized antennas that can maintain a broadband characteristic and can be embedded in a mobile phone.

Since the small-sized antennas occupy a small area in a physical view, its bandwidth is limited to maintain good antenna efficiency. The antenna efficiency represents a power ratio of a power radiated from the antenna to a power supplied to the antenna.

Therefore, it is difficult to apply the small-sized antennas to phones or terminals, which provide services using various frequency bands, for example, T-DMB phones, DVB-H phones, UHF communication terminals, T-DMB/cellular hybrid phones, T-DMB/PCS hybrid phones, and DVB-H/GSM hybrid phones.

There is a need for small-sized antennas that can generate a plurality of resonant frequencies and thus provide multiple resonances, that is, a wideband transmission and reception.

As described above, there is a need for small-sized antennas that have a reduced size, maintain omni-directionality in a mobile phone or the like, is easily installed, have high antenna efficiency, and provide a wideband characteristic.

DISCLOSURE

Technical Problem

An embodiment of the present invention is directed to providing a small-sized monopole antenna that includes an external antenna or an antenna installed inside a dielectric substance. Specifically, an end of the antenna is shorted or opened and thus a plurality of resonant frequencies are generated. The small-sized monopole antenna has high antenna efficiency and is easy to install in a terminal. Further, the small-sized monopole antenna can be implemented in a size less than λ/4.

Technical Solution

In accordance with an aspect of the present invention, there is provided an antenna, which includes: a first antenna element formed of a coaxial cable; a second antenna element sealing the first antenna element and sharing a feed point with the first antenna element; and a feeder cable for feeding electric power to the feed point.

In accordance with another aspect of the present invention, there is provided an antenna, which includes: a first antenna element formed of a coaxial cable; a second antenna element serially connected to the first antenna element and formed of a conductive cable; and a feed cable for feeding electric power to the second antenna element.

In accordance with another aspect of the present invention, there is provided an antenna, which includes: a first antenna element realized in a form of a microstrip line on a board; a second antenna element serially connected to the first antenna element and realized in a form of an etching wire on the board; and a feed cable for feeding electric power to the second antenna element.

In accordance with another aspect of the present invention, there is provided an antenna, which includes: a first antenna element formed of a coaxial cable; a second antenna element serially connected to different positions of the first antenna element and realized in a form of a wire; a third antenna element serially connected to one end of the first antenna element, the other end of the first antenna element being connected to the second antenna element, and the third antenna element being realized in a form of an etching wire on the board; and a feed cable for feeding electric power to the second antenna element.

Advantageous Effects

By providing a small-sized monopole antenna, it is easy to install the antenna in a stubby type or inside a mobile phone. Further, since a plurality of resonant frequencies are generated, a broadband reception is possible and an antenna efficiency is high. Moreover, the antenna can be implemented in a size less than $\lambda/4$.

BEST MODE FOR THE INVENTION

The advantages, features and aspects of the invention will become apparent from the following description of the embodiments with reference to the accompanying drawings, which is set forth hereinafter.

Figure 3:
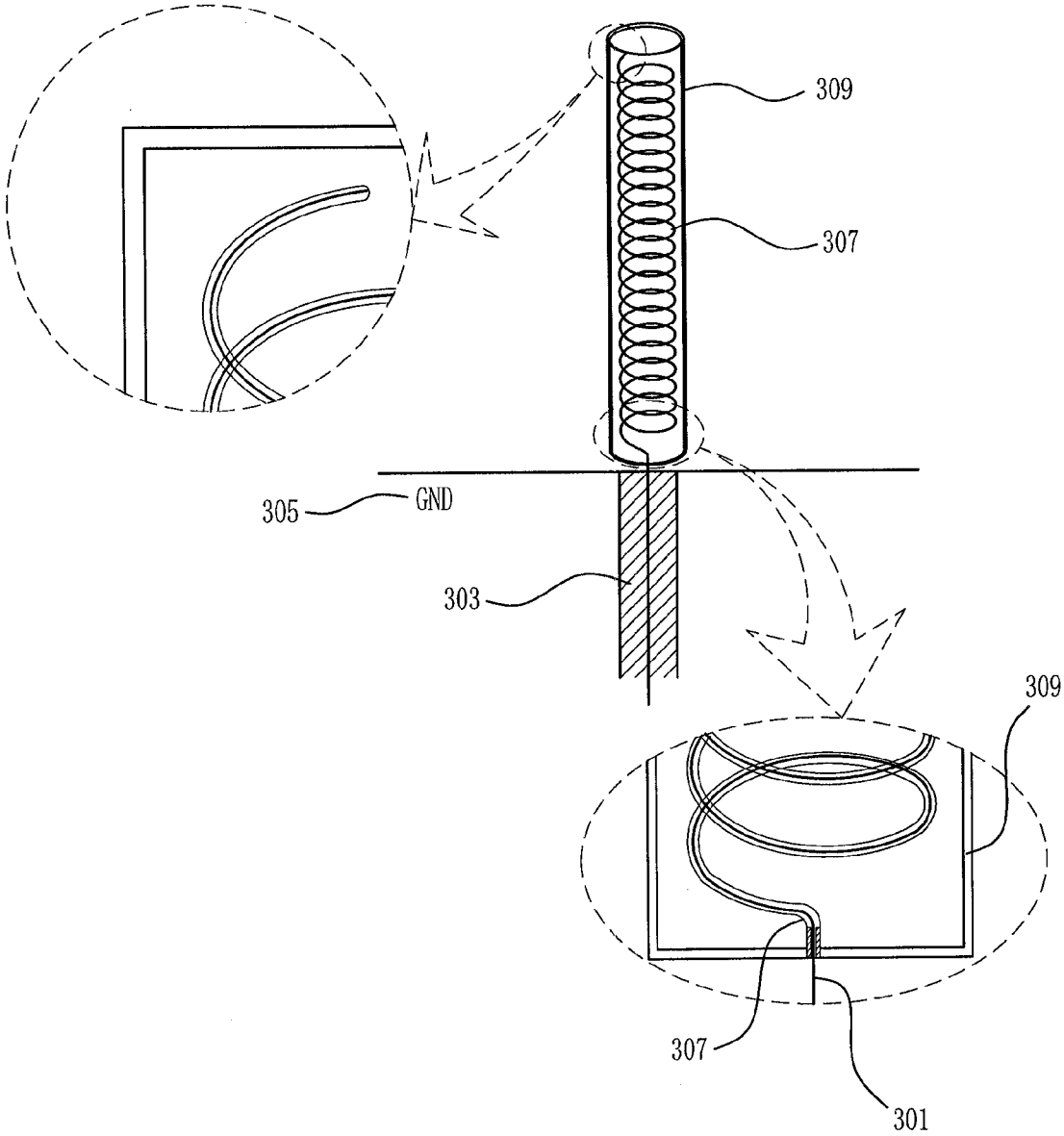
FIG. 3 illustrates a structure of a cable monopole antenna in accordance with an embodiment of the present invention.

FIG. 3 illustrates a structure of a cable monopole antenna in accordance with an embodiment of the present invention.

Referring to FIG. 3, the cable monopole antenna includes an antenna wire 301, a feeder cable 303, a ground plane 305, a coaxial cable 307, and an external antenna element 309. The coaxial cable 307 includes a coaxial cable outer conductor and a coaxial cable inner conductor.

The antenna element has an electrical length determining a resonant frequency.

The coaxial cable 307 is wound within the external antenna element 309 in a spring shape.

In the inside of the external antenna element 309, one end of the coaxial cable 307 is shorted, and the other end of the coaxial cable 307 is connected to the external antenna element 309. Only the coaxial cable inner conductor is exposed out of the external antenna element 309 from the other end connected to the external antenna element 309 and thus is connected to the antenna wire 301. A similar characteristic can be obtained even though the end of the coaxial cable 307 is opened.

That is, the reflectivity when the end of the coaxial cable 307 is shorted is identical to that when the end of the coaxial cable 307 is opened. However, the reflected signals in the two cases have a phase difference of 180 degrees.

In the above-mentioned manner, the electrical length of the coaxial cable 307 can be further extended.

The antenna wire 301 is connected to the feeder cable 303. The feeder cable 303 supplies electric power to the antenna wire 301.

Figure 1:
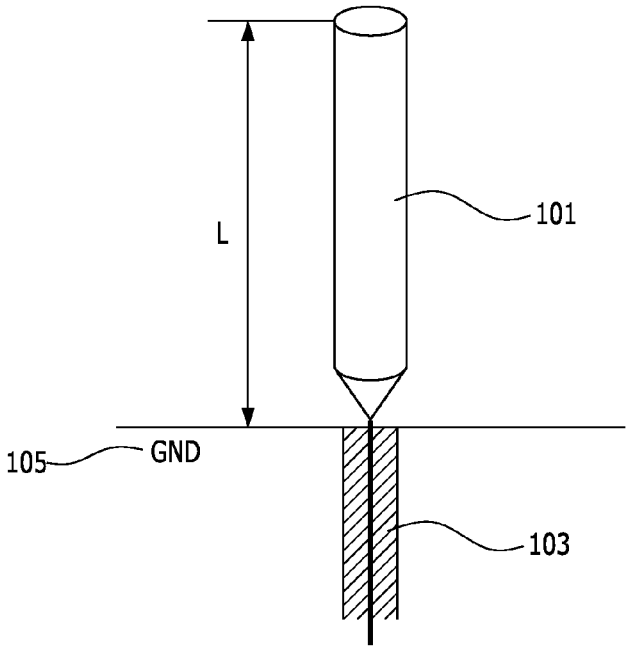
FIG. 1 (PRIOR ART)
FIG. 1 illustrates a structure of a conventional monopole antenna.
Figure 4:
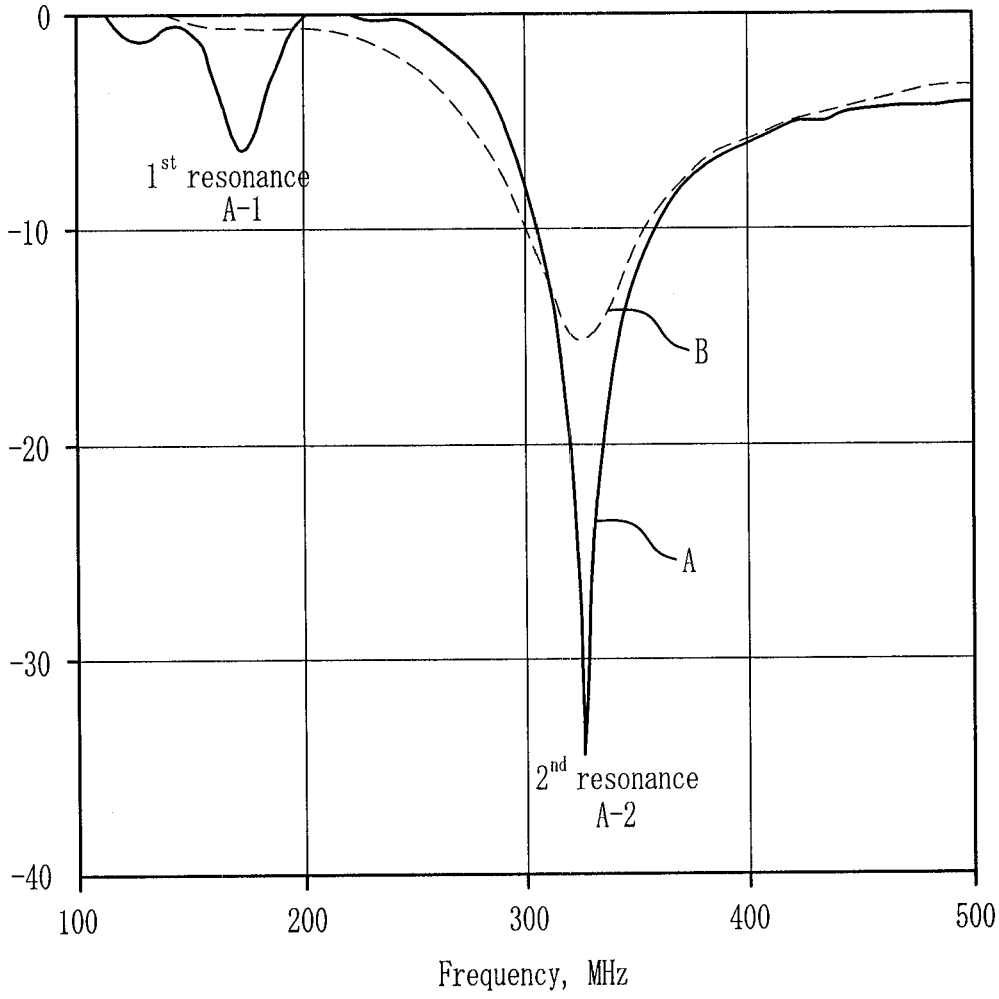
FIG. 4 is a graph illustrating input reflection coefficients (S11) of the monopole antennas shown in FIGS. 1 and 3.

FIG. 4 is a graph illustrating input reflection coefficients (S11) of the monopole antennas shown in FIGS. 1 and 3.

The antenna is a cut-out line an end of which resonates at a specific frequency, so that the signal is not totally reflected but transmitted to the outside with specific magnetic field energy. That is, the antenna is a 1-port device with one input port. Hence, the antenna has only the input reflection coefficient S11. The input reflection coefficient S11 has a minimum value at an operating frequency of the antenna. A signal power inputted to the antenna is maximally radiated at the frequency at which the input reflection coefficient S11 has the minimum value. That is, the best impedance matching is achieved at a position where the input reflection coefficient S11 has the minimum value.

In FIG. 4, a graph A shows the input reflection coefficient S11 of the monopole antenna in accordance with the embodiment of the present invention, and a graph B shows the input reflection coefficient S11 of the conventional monopole antenna. The graph A indicating the monopole antenna in accordance with the embodiment of the present invention exhibits a first resonant frequency A-1 and a second resonant frequency A-2, whereas the graph B indicating the conventional monopole antenna exhibits only a second resonant frequency B-2.

The graph A shows the input reflection coefficient S11 when the length of the coaxial cable 307 is about two times longer than that of the external antenna element 309. The first resonant frequency A-1 is generated at about ⅛ wavelength, and the second resonant frequency A-2 is identical to a resonant frequency B-2 generated by a total antenna length. The resonant frequency B-2 is a resonant frequency of the conventional monopole antenna having no coaxial cable.

Therefore, as the coaxial cable 307 is longer, the resonance occurs at lower frequency. Further, since the resonant frequency A-2 generated by the total antenna length is maintained, an antenna for wireless service transmission/reception using more than two resonant frequencies can be implemented.

Figure 5:
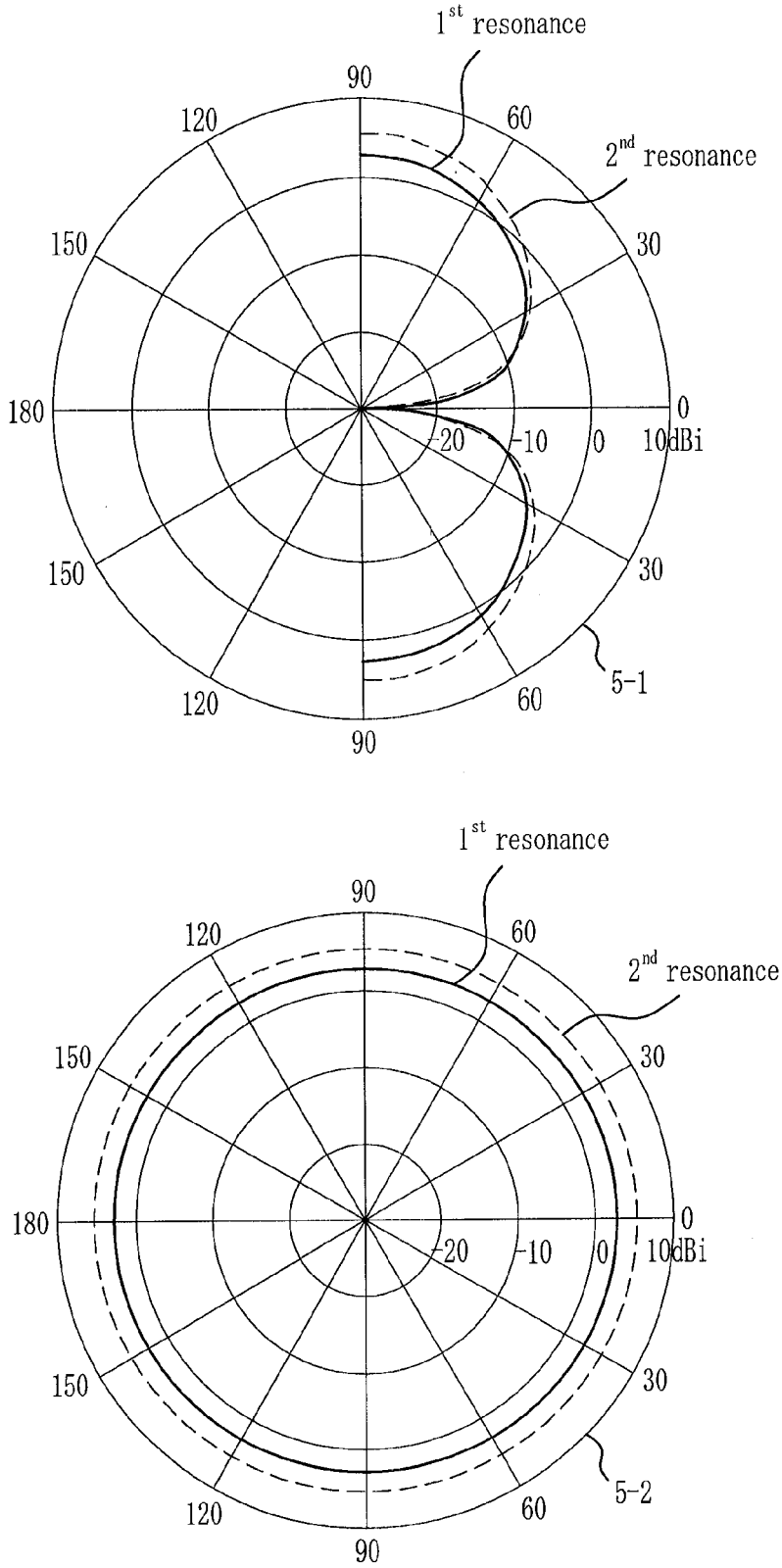
FIG. 5 illustrates a gain pattern at a resonant frequency of the monopole antenna shown in FIG. 3.

FIG. 5 illustrates a gain pattern at a resonant frequency of the monopole antenna shown in FIG. 3.

In FIG. 5, a graph 5-1 shows a gain pattern of a vertically polarized component according to variation of an elevation angle, and a graph 5-2 shows a gain pattern of a vertically polarized component according to variation of an azimuth angle. The elevation angle is an angle radiated vertically with respect to the ground, and the azimuth angle is an angle radiated horizontally with respect to the ground.

From the graph 5-2 showing the gain pattern of the vertically polarized component according to the variation of the azimuth angle, it can be seen that the monopole antenna in accordance with the embodiment of the present invention can maintain the omni-directional vertical polarized pattern. That is, it can be known if the antenna is an antenna used in a portable communication or a terminal that can transmit and receive data at any place.

The following Table 1 shows comparison of features between the monopole antenna in accordance with the embodiment of the present invention and the conventional monopole antenna. The antennas compared have the same total length.

TABLE 1

| | Monopole antenna of the present invention | | Conventional |
|---|---|---|---|
| Feature | First resonance | Second resonance | monopole antenna |
| Frequency (MHz) | 170 | 327 | 325 |
| Gain (dBi) | 3.0 | 5.4 | 5.4 |
| Efficiency (%) | 60 | 99.7 | 95 |
| Radiation Pattern | Omni-directional | Omni-directional | Omni-directional |

As can be seen from Table 1 above, the monopole antenna in accordance with the embodiment of the present invention maintains the second resonant frequency A-2 generated by the total length of the conventional monopole antenna, and also generates the first resonant frequency A-1. Further, the monopole antenna in accordance with the embodiment of the present invention has high antenna efficiency at the second resonant frequency A-2 and achieves the good impedance matching. Thus, the antenna can be used at the second resonant frequency. Furthermore, although the antenna efficiency is reduced at the first resonant frequency A-1, the antenna can transmit and receive broadcasting services in view of the antenna gain and radiation pattern characteristics.

Figure 6:
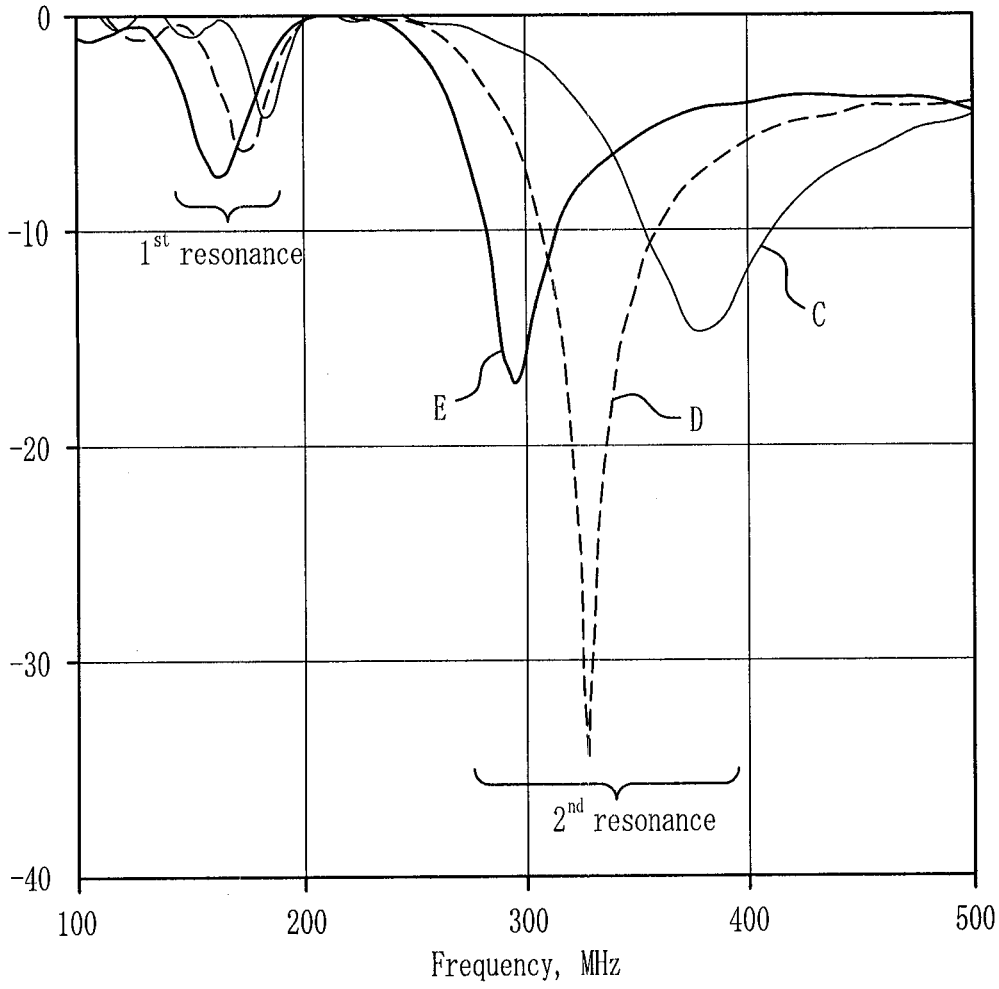
FIG. 6 is a graph illustrating input reflection coefficients S11 of the monopole antenna of FIG. 3 according to length variation of the external antenna element (309).

FIG. 6 is a graph illustrating input reflection coefficients S11 of the monopole antenna of FIG. 3 according to length variation of the external antenna element 309.

As illustrated in FIG. 6, a graph C shows a first resonant frequency and a second resonant frequency when the length of the external antenna element 309 is 15 cm, a graph D shows a first resonant frequency and a second resonant frequency when the length of the external antenna element 309 is 20 cm, and a graph E shows a first resonant frequency and a second resonant frequency when the length of the external antenna element 309 is 25 cm.

Herein, the length of the coaxial cable 307 is maintained constantly. Thus, the variation in the length of the external antenna element 309 means the variation in the total antenna length.

In the case of the first resonant frequency, there is almost no difference in the resonant frequency according to the variation in the length of the external antenna element 309. That is, the first resonant frequency is determined by the electrical length of the coaxial cable 307.

In the case of the second resonant frequency, the resonant frequency is highest when the length of the external antenna element 309 is 15 cm (see the graph C), and it is lowest when the length of the external antenna element 309 is 25 cm (see the graph E). That is, as the external antenna element 309 is longer, the resonance length increases and thus the resonant frequency decreases. Therefore, the second resonant frequency can be controlled by varying the length of the external antenna element 309.

As described above, the first resonant frequency and the second resonant frequency are independent of each other. Thus, the frequency control can be achieved by separately varying the length of the coaxial cable 307 and the length of the external antenna element 309.

Hence, the monopole antenna in accordance with the embodiment of the present invention has advantages in that a dual-band antenna can be easily designed and a broadband characteristic can be obtained by narrowing the separation between the dual-band frequencies, even though the resonance occurs between adjacent frequencies.

Further, the helical antenna also generates separate resonant frequencies and can control the separation between the resonant frequencies. If the wire of the helical antenna is densely wound, the directly proportional relationship between the total antenna length and the resonant frequency is not maintained. Using this characteristic, the separation between the resonant frequencies can be controlled.

Figure 7:
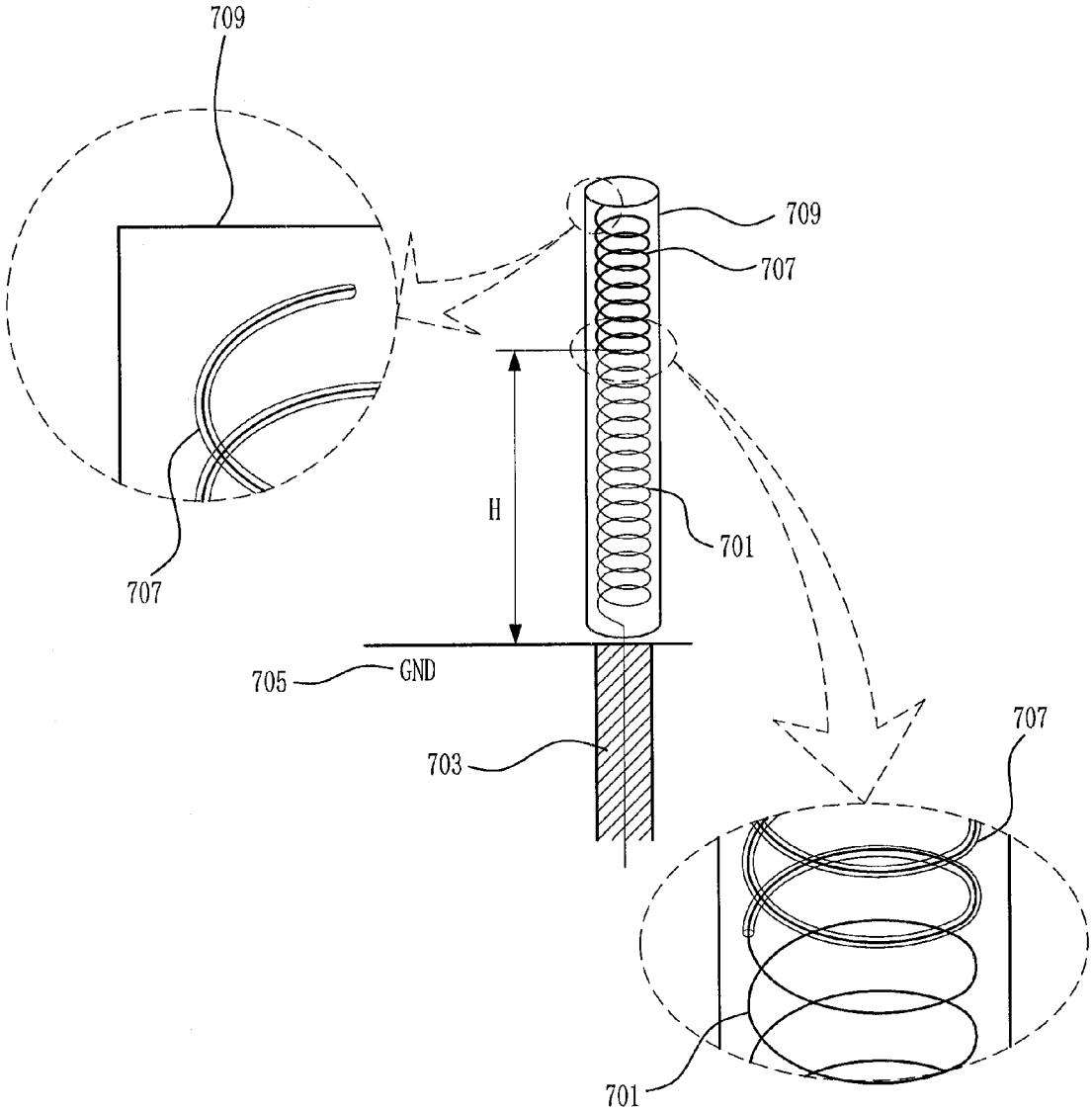
FIG. 7 illustrates a structure of a helical type cable monopole antenna in accordance with an embodiment of the present invention.

FIG. 7 illustrates a structure of a helical type cable monopole antenna in accordance with an embodiment of the present invention.

Referring to FIG. 7, the helical type cable monopole antenna includes an antenna wire 701, a feeder cable 703, a ground plane 705, a coaxial cable 707, and a dielectric substance 709.

The antenna element is installed inside the dielectric substance 709. The antenna wire 701 is wound inside the dielectric substance 709, and the coaxial cable 707 is wound from a position spaced apart from the ground plane 705 by H. That is, at a position spaced apart from the ground plane 705 by H, the antenna wire 701 and the inner conductor of the coaxial cable 707 are connected to each other. At this point, only the antenna wire 701 is exposed out of the dielectric substance 709 and connected to the feeder cable 703.

The feeder cable 703 feeds electric power to the antenna wire 701.

An end of the coaxial cable 707 wound together with the antenna wire 701 is shorted inside the dielectric substance 709. A similar characteristic can also be obtained when the end of the coaxial cable 707 is opened.

Figure 2:
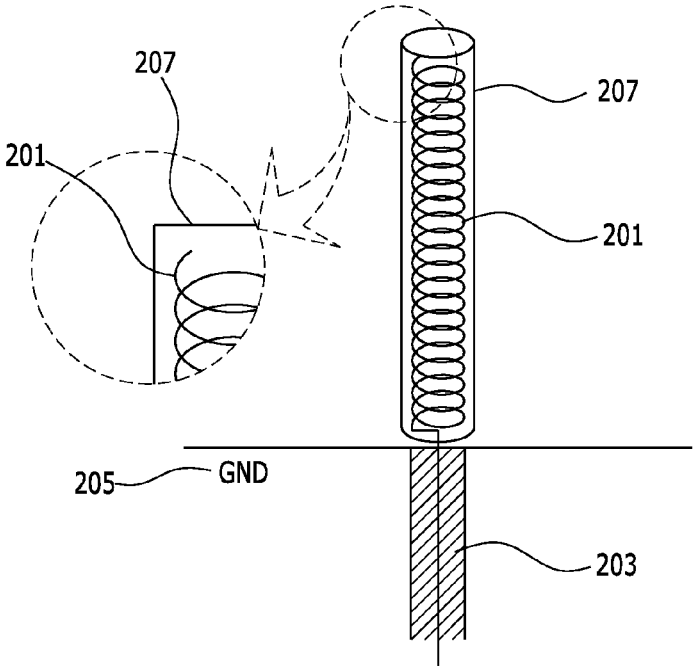
FIG. 2 (PRIOR ART)
FIG. 2 illustrates a structure of a conventional helical monopole antenna embedded in a dielectric substance.
Figure 8:
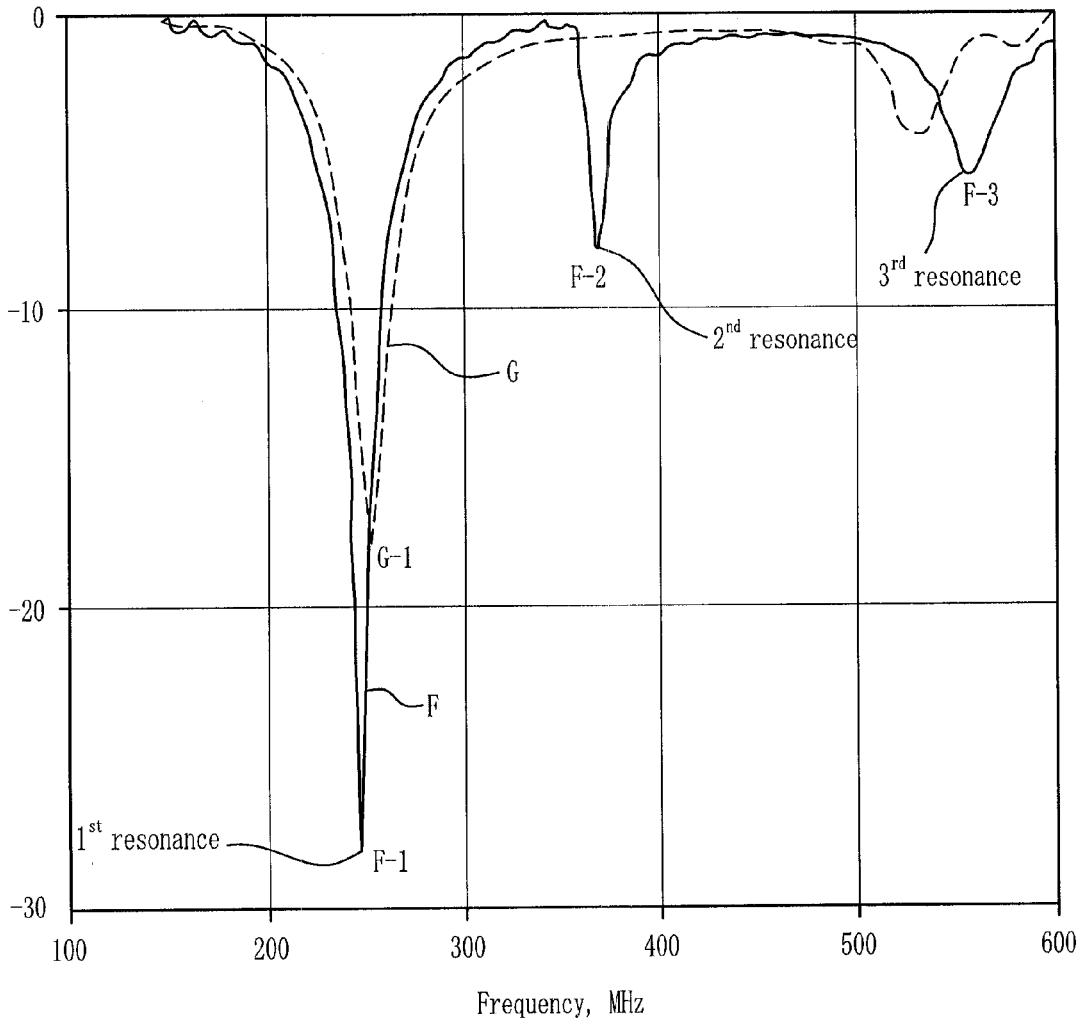
FIG. 8 is a graph illustrating input reflection coefficients S11 of the helical antenna of FIG. 7 and the conventional helical antenna of FIG. 2.

FIG. 8 is a graph illustrating input reflection coefficients S11 of the helical antenna of FIG. 7 and the conventional helical antenna of FIG. 2. The antennas compared herein have the same total length.

In FIG. 8, a graph F shows an input reflection coefficient S11 of the helical antenna in accordance with the embodiment of the present invention, and a graph G shows an input reflection coefficient S11 of the conventional helical antenna. The helical antenna in accordance with the embodiment of the present invention, indicated by the graph F, exhibits a first resonant frequency F-1, a second resonant frequency F-2, and a third resonant frequency F-3. The conventional helical antenna, indicated by the graph G, exhibits only a first resonant frequency G-1. In the helical antenna in accordance with the embodiment of the present invention, the first resonant frequency F-1 is identical to the resonant frequency G-1 generated by the total antenna length. The resonant frequency G-1 is a resonant frequency of the conventional helical antenna having no coaxial cable.

Thus, the second resonant frequency F-2 and the third resonant frequency F-3 are generated by the coaxial cable 707. Further, since the resonant frequency F-1 generated by the total antenna length is maintained, an antenna for wireless service transmission/reception using more than two resonant frequencies can be implemented.

Figure 9:
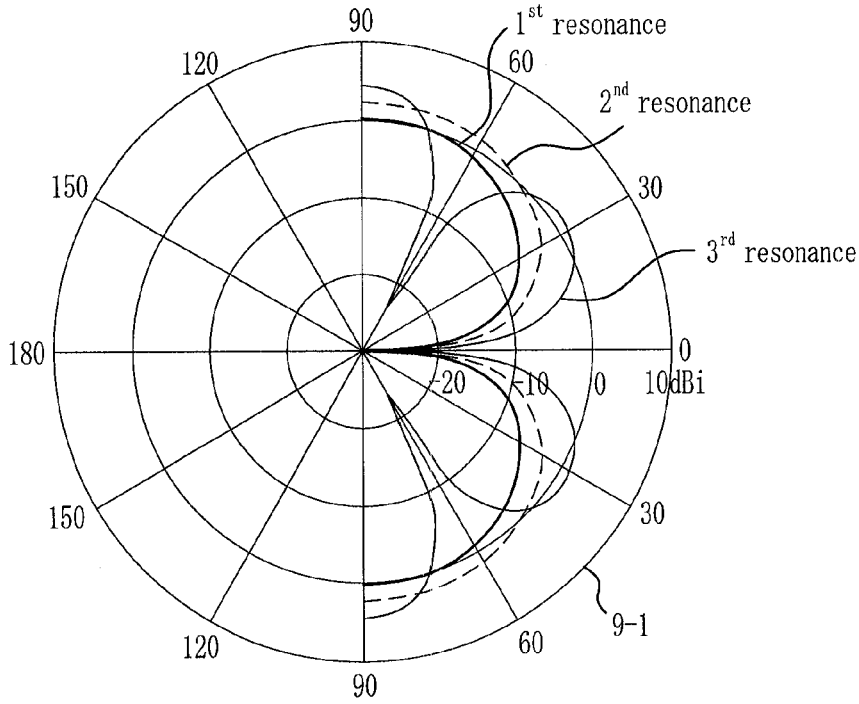
FIG. 9 illustrates a gain pattern at a resonant frequency of the helical antenna shown in FIG. 7.
Figure 9:
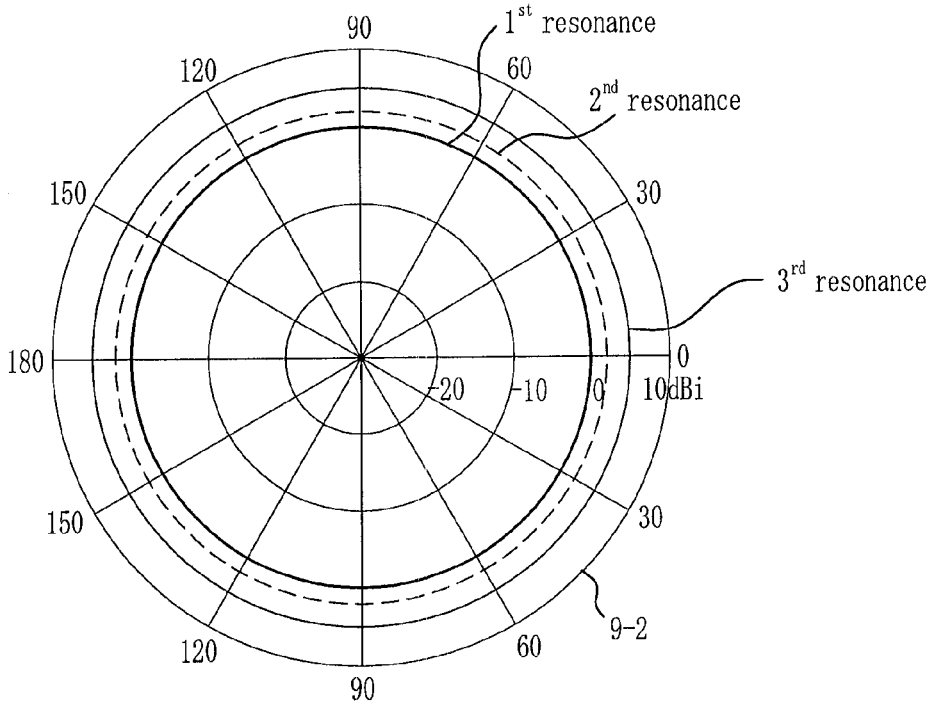

FIG. 9 illustrates a gain pattern at a resonant frequency of the helical antenna shown in FIG. 7.

In FIG. 9, a graph 9-1 shows a gain pattern of a vertically polarized component according to variation of an elevation angle, and a graph 9-2 shows a gain pattern of a vertically polarized component according to variation of an azimuth angle.

From the graph 9-2 showing the gain pattern of the vertically polarized component according to the variation of the azimuth angle, it can be seen that the helical antenna in accordance with the embodiment of the present invention can maintain the omni-directional vertical polarized pattern at the first resonant frequency F-1, the second resonant frequency F-2, and the third resonant frequency F-3.

The following Table 2 shows the features of the helical antenna in accordance with the embodiment of the present invention.

TABLE 2

| Feature | First resonance | Second resonance | Third resonance |
|---|---|---|---|
| Frequency (MHz) | 294 | 536 | 913 |
| Gain (dBi) | 0.4 | 2.3 | 4.5 |

TABLE 2-continued

| Feature | First resonance | Second resonance | Third resonance |
|---|---|---|---|
| Efficiency (%) | 99 | 76 | 70 |
| Radiation pattern | Omni-directional | Omni-directional | Omni-directional |

As can be seen from Table 2 above, the helical antenna in accordance with the embodiment of the present invention has high antenna efficiency at the first resonant frequency F-1 and achieves the good impedance matching. Thus, the helical antenna can be used at the first resonant frequency. Furthermore, although the antenna efficiency is reduced at the second resonant frequency F-2, the helical antenna has high antenna gain and omni-directionality and thus it can be used as a terminal antenna.

The helical antenna can control the separation between the first resonant frequency F-1 and the second resonant frequency F-2, which will be described below in detail with reference to FIGS. 10 and 11.

Figure 10:
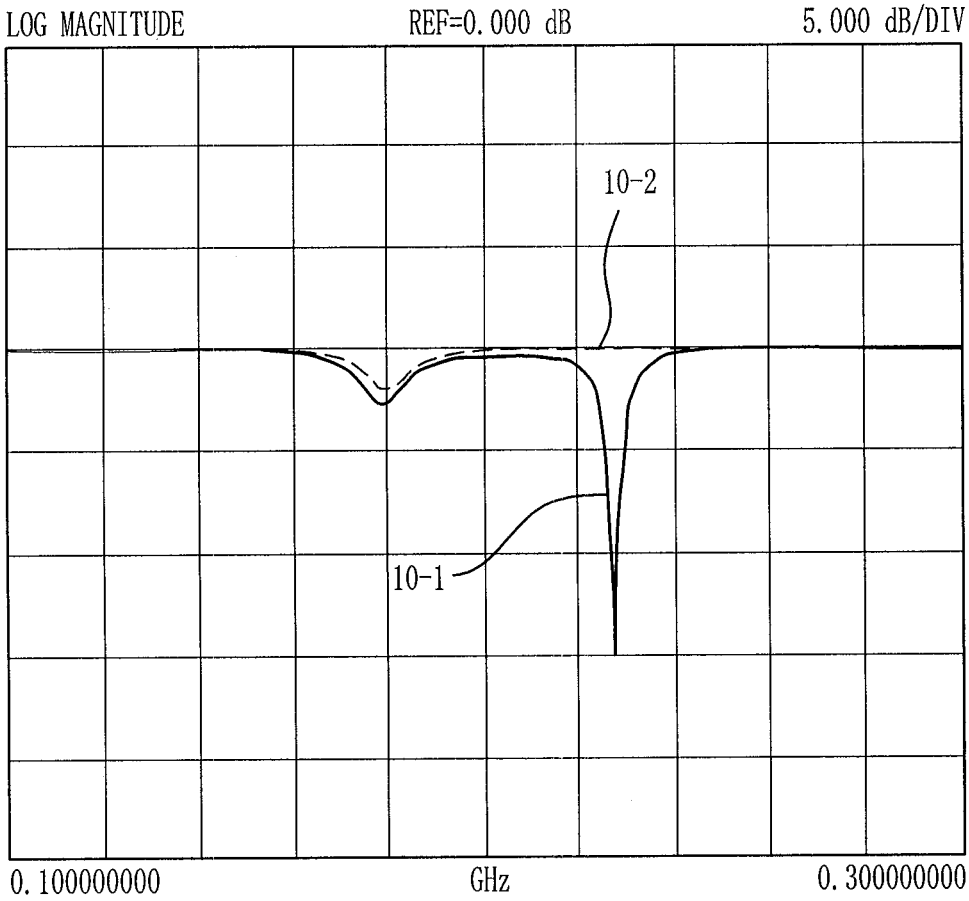
FIG. 10 is a graph illustrating input reflection coefficients S11 of the helical antenna of FIG. 7 and the conventional helical antenna of FIG. 2 in a 7-cm T-DMB RX antenna.

FIG. 10 is a graph illustrating input reflection coefficients S11 of the helical antenna of FIG. 7 and the conventional helical antenna of FIG. 2 in a 7-cm T-DMB RX antenna.

Referring to FIG. 10, the T-DMB RX antenna is a $\lambda/24$ antenna having a height of 7 cm from the ground plane. A graph 10-1 shows an input reflection coefficient S11 of the helical antenna in accordance with the embodiment of the present invention, and a graph 10-2 shows an input reflection coefficient S11 of the conventional helical antenna.

By varying the separation between the first resonant frequency and the second resonant frequency, both the first resonant frequency and the second resonant frequency can be generated at T-DMB broadcasting band, for example, 176-216 MHz for Korean T-DMB.

Therefore, the helical antenna in accordance with the embodiment of the present invention can achieve broadband transmission/reception by generating a plurality of resonant frequencies, even when the height of the helical antenna from the ground plane is less than ⅛ wavelength.

If the wire of the helical antenna is densely wound, the directly proportional relationship between the total antenna length and the resonant frequency is riot maintained. Using this characteristic, the separation between the resonant frequencies can be controlled.

Figure 11:
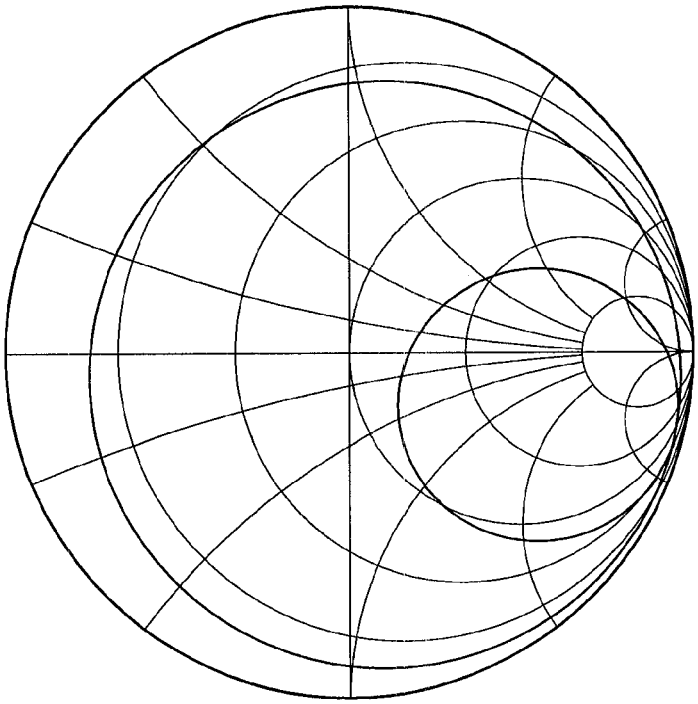
FIG. 11 illustrates smith charts of the helical antenna of FIG. 7 and the conventional antenna of FIG. 2.
Figure 11:
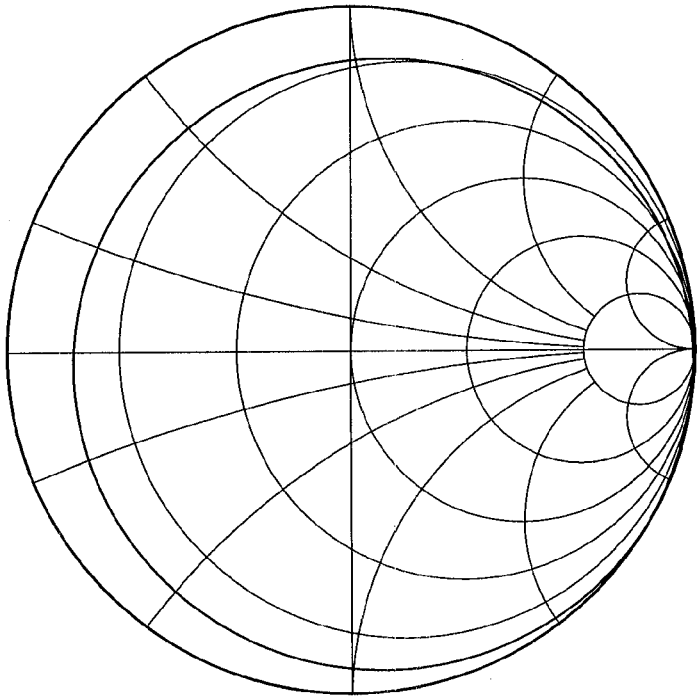

FIG. 11 illustrates smith charts of the helical antenna of FIG. 7 and the conventional antenna of FIG. 2.

Referring to FIG. 11, a graph 11-1 shows a smith chart of the helical antenna in accordance with the embodiment of the present invention, and a graph 11-2 shows a smith chart of the conventional antenna. The antennas are $\lambda/24$ antennas having a height of 7 cm from the ground plane.

As can be seen from the graph 11-2, as a small square approaches 1, the impedance matching is well achieved. Thus, the impedance matching is achieved at the second resonant frequency better than at the first resonant frequency. Hence, the helical antenna can easily control the separation between the resonant frequencies.

Figure 12:
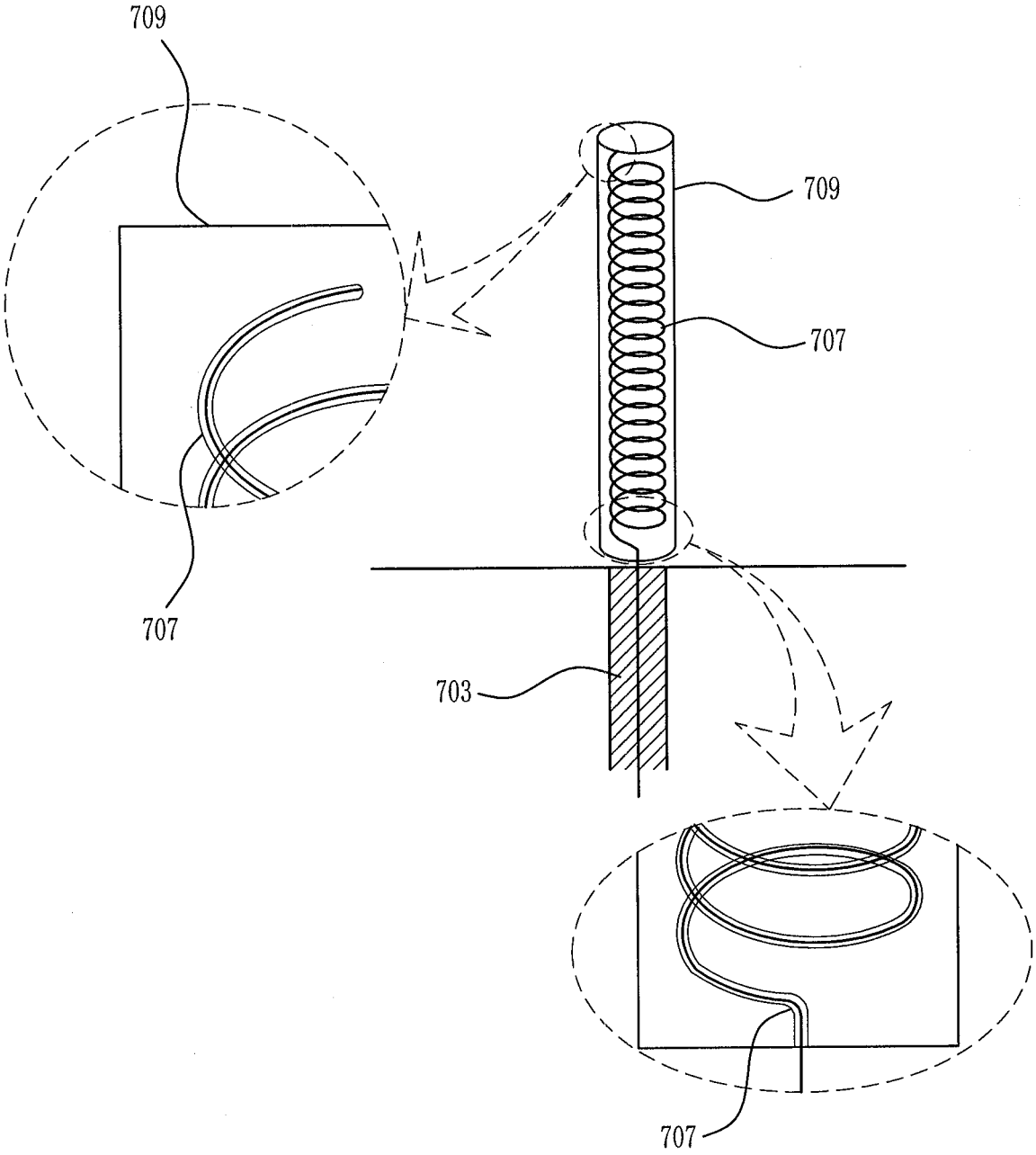
FIG. 12 illustrates a structure of a helical antenna of FIG. 7 in accordance with another embodiment of the present invention.

FIG. 12 illustrates a structure of a helical antenna of FIG. 7 in accordance with another embodiment of the present invention.

Referring to FIG. 12, the helical antenna includes an antenna wire 701, a feeder cable 703, a ground plane 705, a coaxial cable 707, and a dielectric substance 709.

Unlike in FIG. 7, the coaxial cable 707 is wound from the starting portion of the dielectric substance 709. That is, a portion where only the antenna wire 701 is wound does not exist inside the dielectric substance 709. Outside the dielectric substance 709, the inner conductor of the coaxial cable 707 is connected to the antenna wire 701, and the antenna wire 701 is connected to the feeder cable 703.

Figure 13:
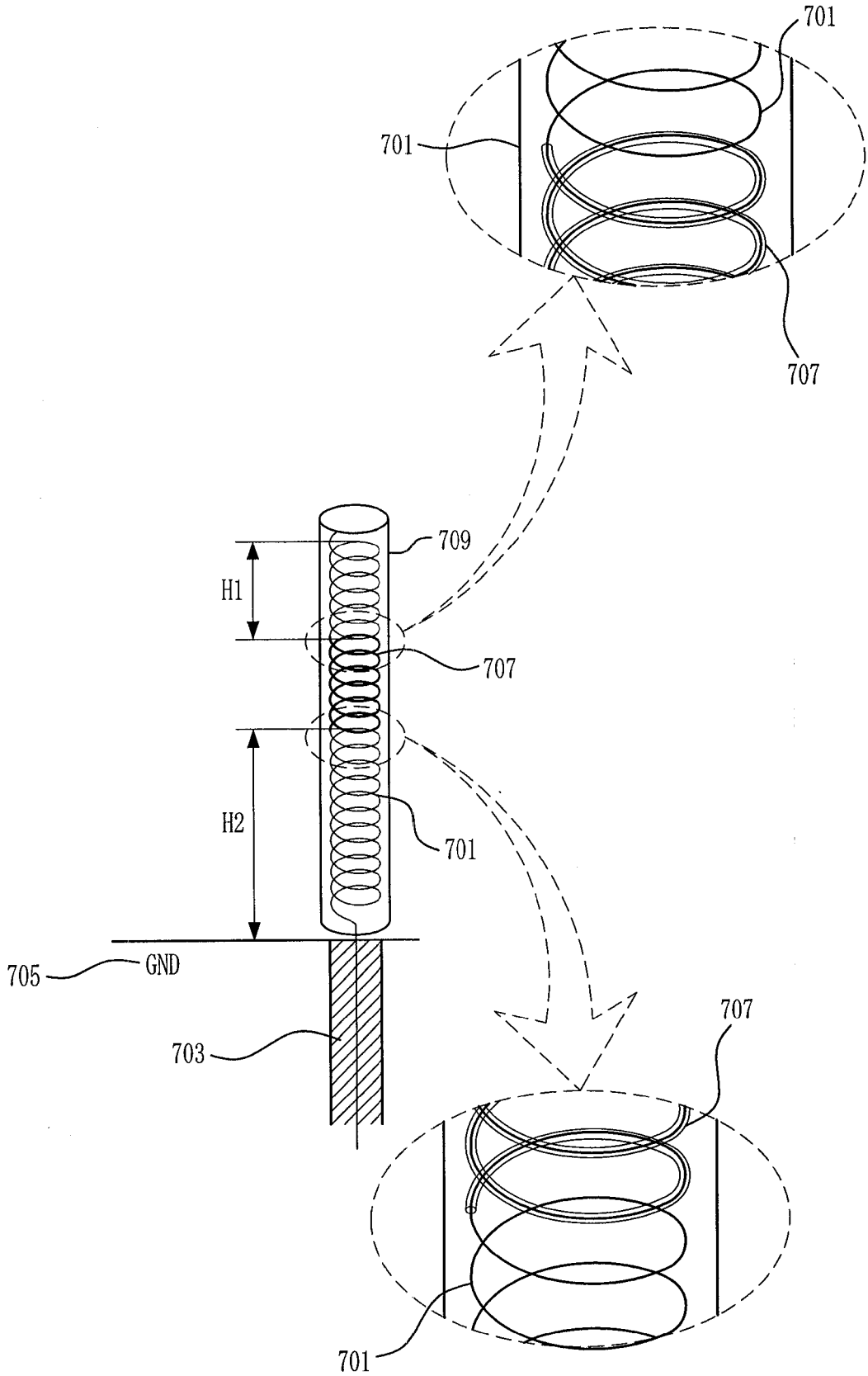
FIG. 13 illustrates a structure of a helical antenna of FIG. 7 in accordance with a further another embodiment of the present invention.

FIG. 13 illustrates a structure of a helical antenna of FIG. 7 in accordance with a further another embodiment of the present invention.

Referring to FIG. 13, the helical antenna includes an antenna wire 701, a feeder cable 703, a ground plane 705, a coaxial cable 707, and a dielectric substance 709.

Unlike in FIG. 7, the antenna wire 701 is wound inside the dielectric substance 709, while the coaxial cable 707 is wound from a predetermined position. Further, an end of the coaxial cable 707 is shorted, and the antenna wire 701 is again wound from a position where the coaxial cable 707 is shorted. That is, the portion where the coaxial cable 707 is wound inside the dielectric substance 709 is limited within a predetermined section, and both ends of the coaxial cable 707 are connected to the antenna wire 701.

As illustrated in FIGS. 7, 12 and 13, the reason why the section where the coaxial cable 707 is wound is different is that each matching condition changes. For example, the coaxial cable 707 may be installed at different sections according to a desired resonant frequency, a manufacturing process, and a manufacturing cost.

Figure 14:
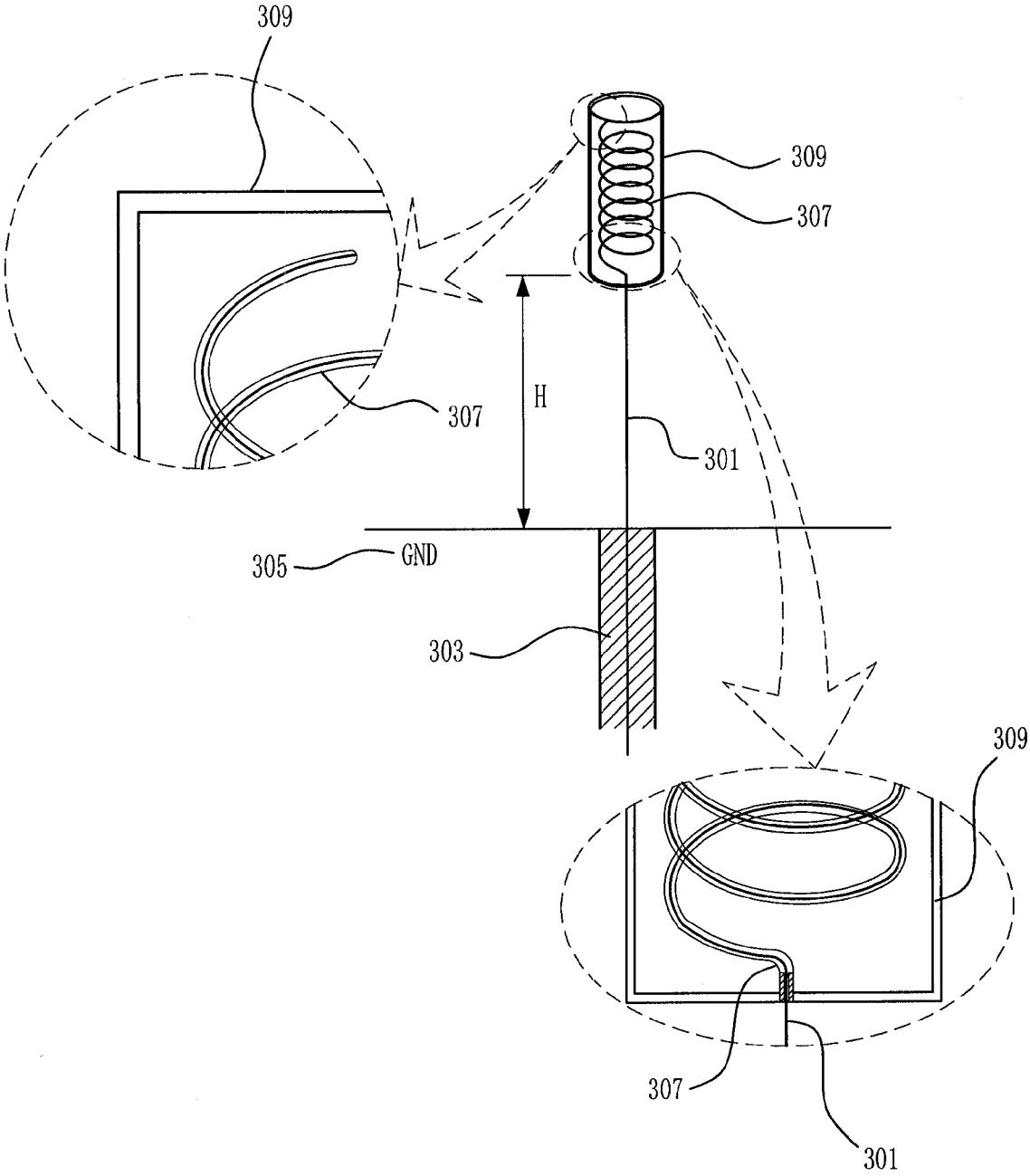
FIG. 14 illustrates a monopole antenna of FIG. 3 in accordance with a further another embodiment of the present invention.

FIG. 14 illustrates a monopole antenna of FIG. 3 in accordance with a further another embodiment of the present invention.

Referring to FIG. 14, the monopole antenna includes an antenna wire 301, a feeder cable 303, a ground plane 305, a coaxial cable 307, and an external antenna element 309.

Unlike the monopole antenna of FIG. 3, the external antenna element 309 is installed from a position spaced apart from the ground plane 305 by H. That is, the external antenna element 309, the coaxial cable 307, and the antenna wire 301 are connected to one another at a position spaced apart from the ground plane 305 by H.

Since the total length of the antenna element is smaller than that of the antenna element of the monopole antenna of FIG. 3, a resonant frequency with a higher frequency band is generated.

Figure 15:
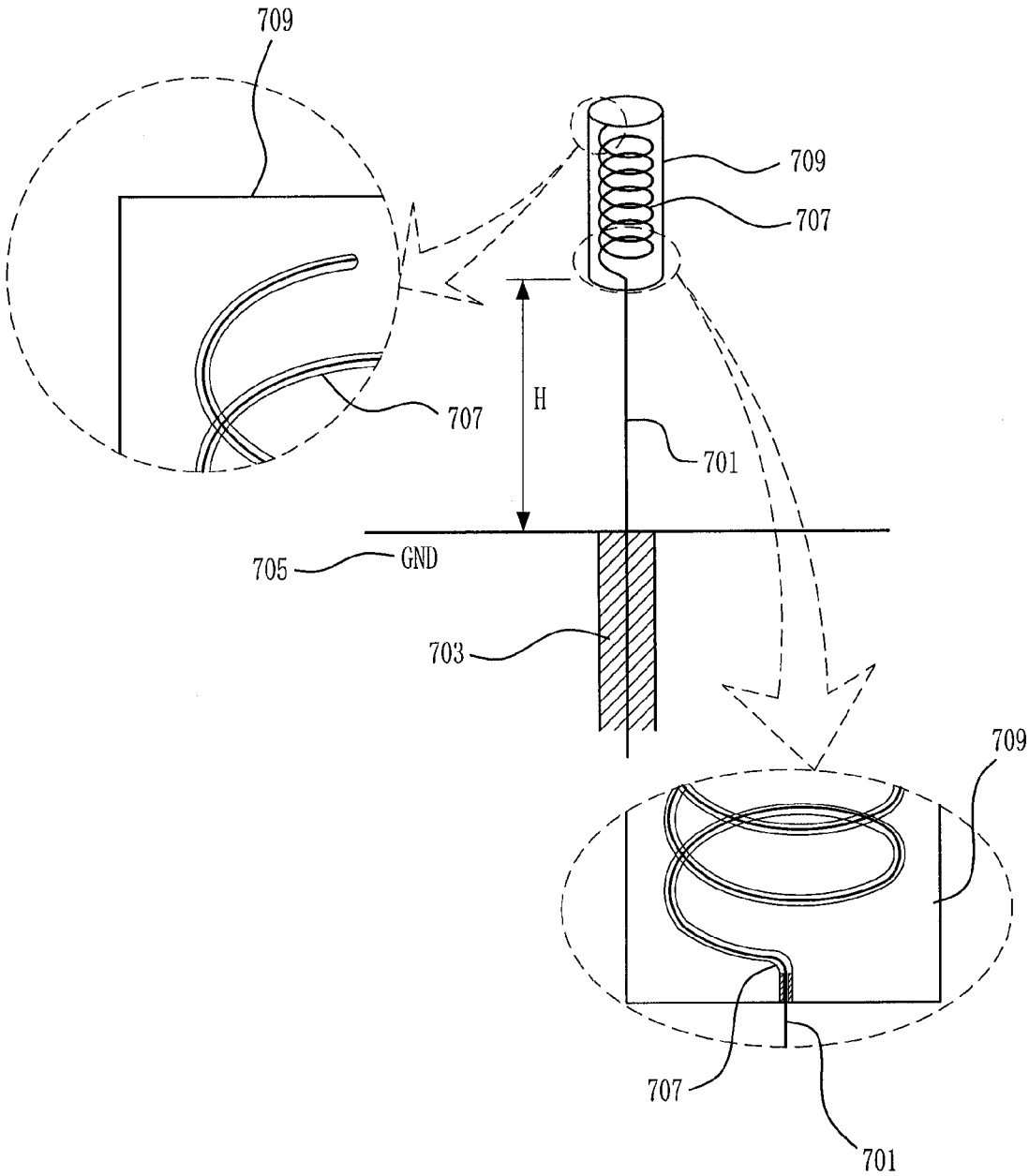
FIG. 15 illustrates a helical antenna of FIG. 12 in accordance with a further another embodiment of the present invention.

FIG. 15 illustrates a helical antenna of FIG. 12 in accordance with a further another embodiment of the present invention.

Referring to FIG. 15, the helical antenna includes an antenna wire 701, a feeder cable 703, a ground plane 705, a coaxial cable 707, and a dielectric substance 709.

Unlike the helical antenna of FIG. 12, the dielectric substance 709 is installed from a position spaced apart from the ground plane 750 by H. That is, a starting portion of the dielectric substance 709 around which the coaxial cable 707 is wound exists at a position spaced apart from the ground plane 305 by H.

Figure 16:
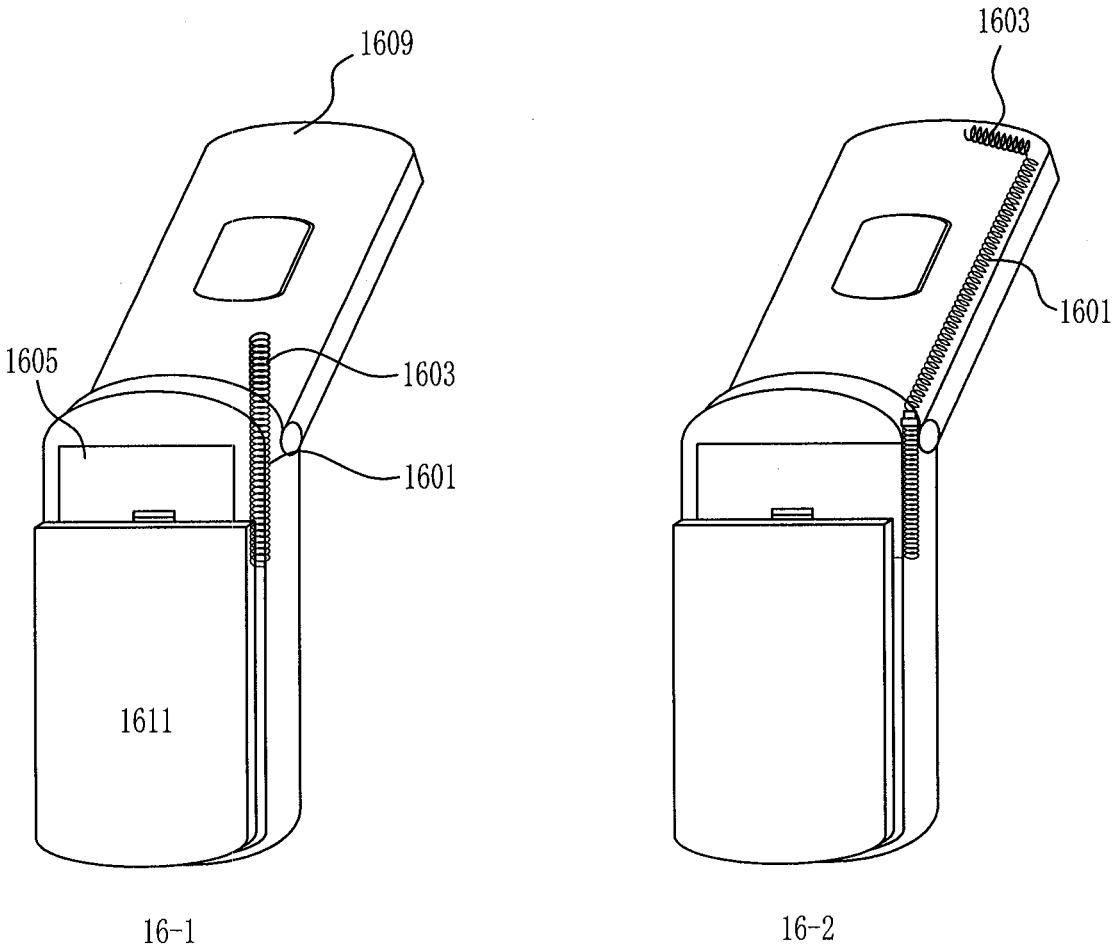
FIG. 16 illustrates a folder type mobile phone where the monopole antenna in accordance with the embodiment of the present invention is installed.

FIG. 16 illustrates a folder type mobile phone where the monopole antenna in accordance with the embodiment of the present invention is installed.

Referring to FIG. 16, the folder type mobile phone includes an antenna wire 1601, a coaxial cable 1603, a printed circuit board (PCB) 1605, a phone body 1607, a phone cover 1609, and a phone battery 1611. A helical monopole antenna 16-1 may be manufactured in a stubby type, or a helical monopole antenna 16-2 may be mounted on the phone cover 1609.

The stubby-type helical monopole antenna 16-1 is installed in parallel with the phone battery 1611 mounted on the backside of the phone body 1607. The antenna wire 1601 is connected to the PCB 1605 connected to the phone battery 1611, so that it can be supplied with electric power.

The helical monopole antenna 16-2 mounted on the phone cover 1609 is installed over the backside of the phone body 1607 and the phone cover 1609. The antenna wire 1601 is connected to the PCB 1605 connected to the phone battery 1611, so that it can be supplied with electric power. Further, the electric connection is also possible even when the phone cover 1609 is opened. Such an antenna is useful in a mobile phone that must open its phone cover 1609 so as to view an image like T-DM or DVB-H. It is possible to solve a problem that antenna characteristics are changed due to damage or deformation of the antenna when the number of opening/closing of a hinge increases.

Figure 17:
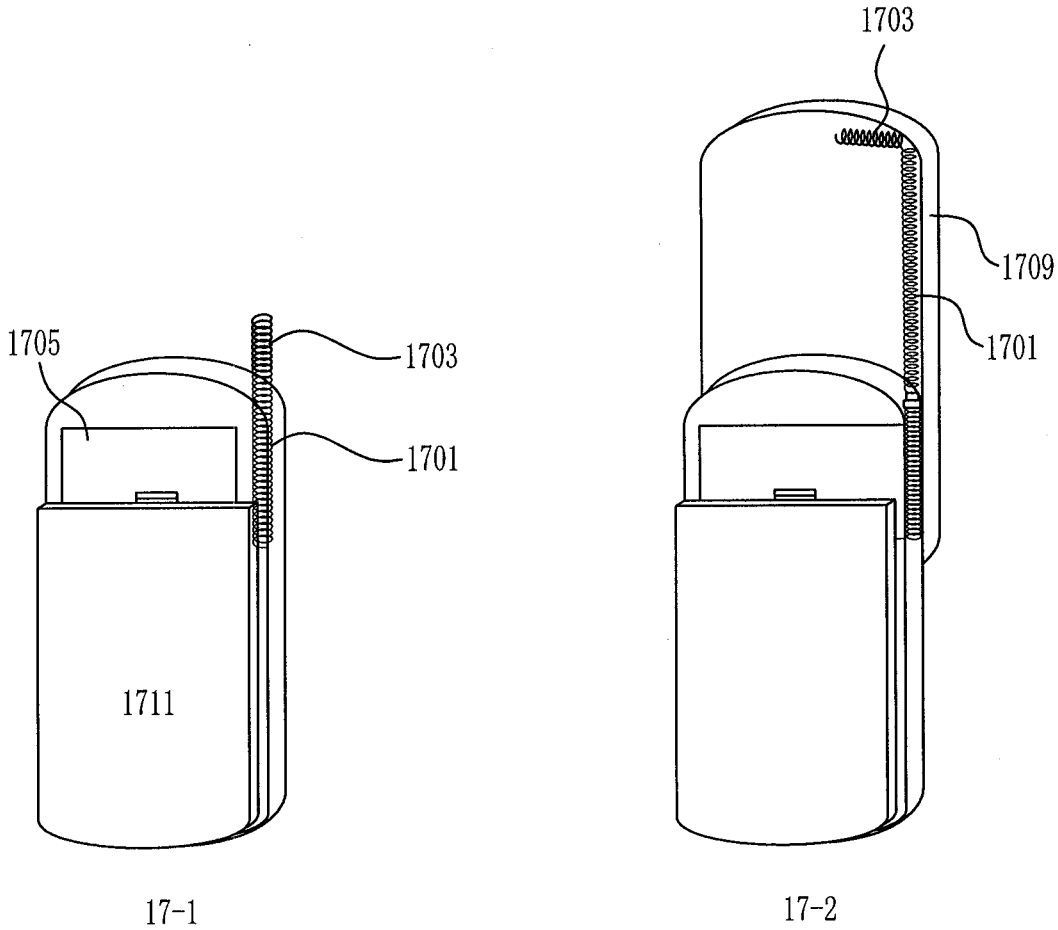
FIG. 17 illustrates a slide type mobile phone where the monopole antenna in accordance with the embodiment of the present invention is installed.

FIG. 17 illustrates a slide type mobile phone where the monopole antenna in accordance with the embodiment of the present invention is installed.

Referring to FIG. 17, the slide type mobile phone includes an antenna wire 1701, a coaxial cable 1703, a PCB 1705, a phone body 1707, a phone cover 1709, and a phone battery 1711. A helical monopole antenna 17-1 may be manufactured in a stubby type, or a helical monopole antenna 17-2 may be mounted on the phone cover 1709.

The stubby-type helical monopole antenna 17-1 is installed in parallel with the phone battery 1711 mounted on the backside of the phone body 1707. The antenna wire 1701 is connected to the PCB 1705 connected to the phone battery 1711, so that it can be supplied with electric power.

The helical monopole antenna 17-2 mounted on the phone cover 1709 is installed over the backside of the phone body 1707 and the phone cover 1709. The antenna wire 1701 is connected to the PCB 1705 connected to the phone battery 1711, so that it can be supplied with electric power. Further, the electric connection is also possible even when the phone cover 1709 is opened.

In the folder type mobile phone of FIG. 16 and the slide type mobile phone of FIG. 17, the antenna can be used as an antenna dedicated to RF communications such as W-LAN, PCS, and Wibro, so that the antenna element installed in the phone body can operate independently. Further, by installing the antennas of FIGS. 3 to 14 in the phone body 1607, multiband communications are possible and a variety of services can be transmitted and received.

Figure 18:
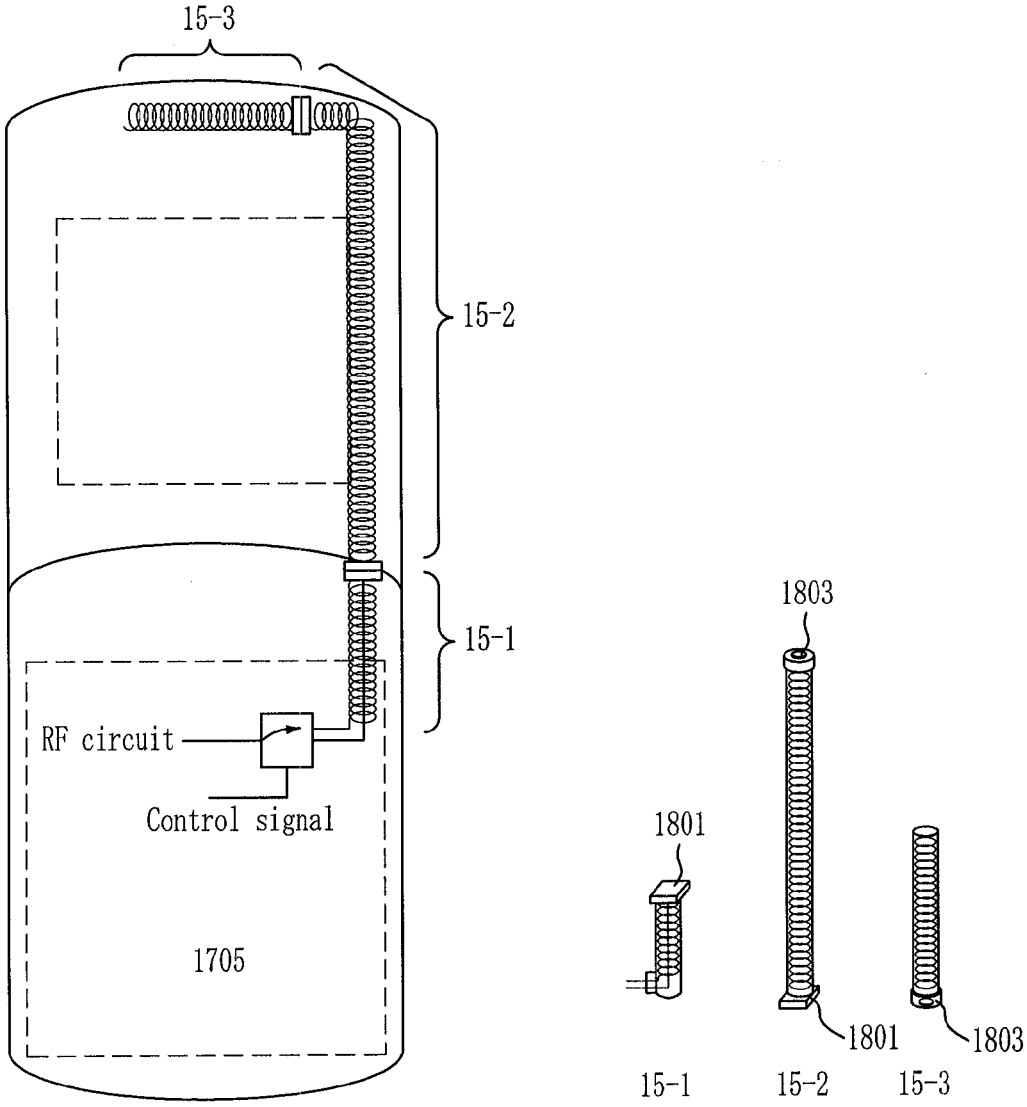
FIG. 18 illustrates a slide type mobile phone where the monopole antenna in accordance with the embodiment of the present invention is installed in an assembly type.

FIG. 18 illustrates a slide type mobile phone where the monopole antenna in accordance with the embodiment of the present invention is installed in an assembly type.

Referring to FIG. 18, the slide type mobile phone includes a first antenna element 18-1, a second antenna 18-2, a third antenna element 18-3, and a PCB circuit 1705.

By installing the monopole antenna in an elastic dielectric substance, for example a rubber, it is possible to implement an antenna that can maintain antenna performance and be easily installed.

In addition, the antenna is implemented in the assembly type by dividing it into three elements 18-1, 18-2 and 18-3. Thus, antennas with various sizes can be manufactured. Further, the antennas can be easily manufactured and installed.

That is, a plurality of antenna elements 18-1, 18-2 and 18-3 are manufactured by installing antenna wires with different lengths in dielectric bodies with different electricity. The first antenna element 18-1 connected to the PCB circuit 1705 inside the mobile phone is connected to the second antenna element 18-2. The second antenna element 18-2 is connected to the third antenna element 18-3.

A contact connection conductor 1801 is provided at one end of the antenna element, for example the first antenna element 18-1, connected to the PCB circuit 1705 inside the mobile phone. A contact connection conductor 1801 is provided at one end of the antenna element, for example the second antenna element 18-2, connected to the antenna element connected to the PCB circuit 1705 inside the mobile phone. Thus, the antenna elements can be connected to each other.

Ends of the coaxial cables of the antenna elements, for example the second and third antenna elements, which are not connected to the PCB circuit 1705 inside the mobile phone, are shorted or opened.

A screw connection conductor 1803 is provided at one end of the antenna element, for example the second antenna element, connecting the antenna elements. Thus, the antenna element can be connected to another antenna element having the contact connection conductor.

Since one end of the last antenna element, for example the third antenna element, constituting the end portion of the antenna is not connected to another antenna element, the last antenna element does not include the contact connection conductor 1801 or the screw connection conductor 1803. An end of the coaxial cable of the last antenna element is shorted or opened.

Figure 19:
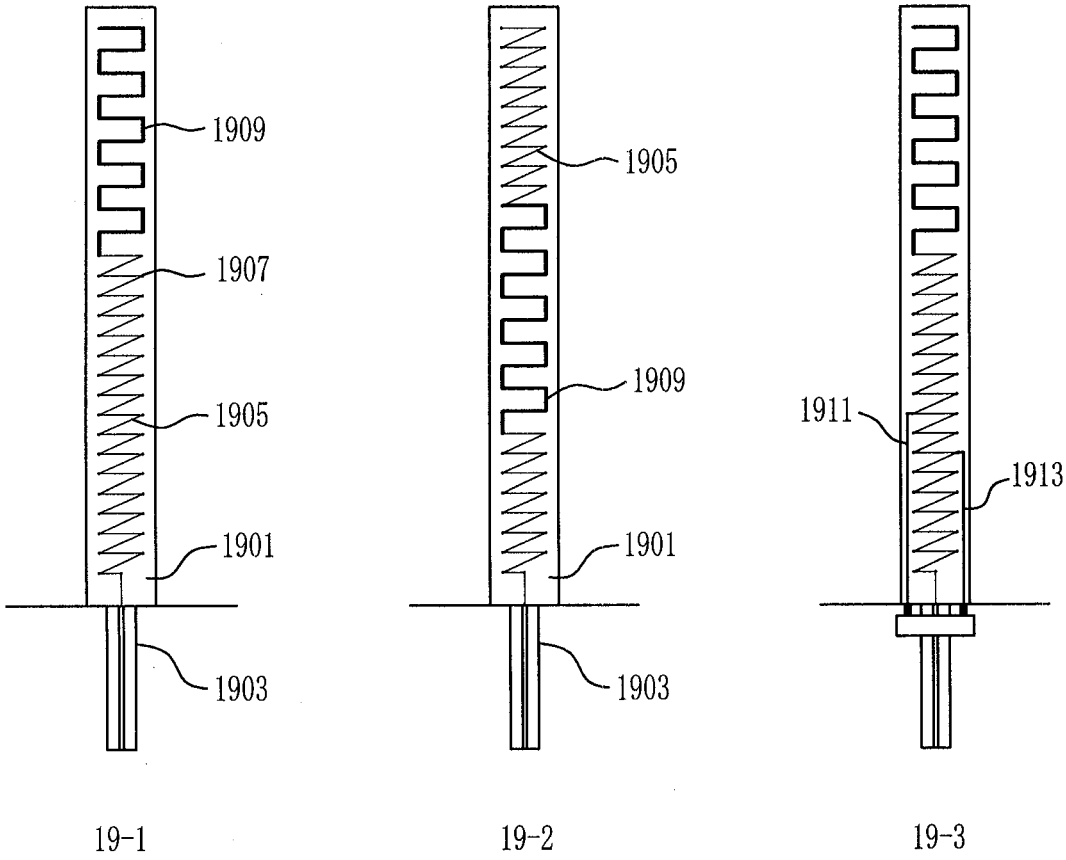
FIG. 19 illustrates a helical type monopole antenna implemented in a PCB type in accordance with an embodiment of the present invention.

FIG. 19 illustrates a helical type monopole antenna implemented in a PCB type in accordance with an embodiment of the present invention.

An RF switch is installed on a PCB. The RF switch is automatically switched according to channel information, such that it can control electric power supplied to the antenna. Further, when the antenna has a plurality of feed points, the feed points can be selected through the control of the RF switch. Thus, a resonant frequency can be variously controlled by varying a length from the feed point to the end of the antenna, that is, a total antenna length.

Referring to FIG. 19, the helical type monopole antenna includes a PCB circuit 1901, a feed microstrip line 1903, an etching antenna wire 1905, a via 1907, and an antenna microstrip line 1909. When a plurality of feed points exist, the helical type monopole antenna further includes a first branched etching antenna wire 1911 and a second branched etching antenna wire 1913. The PCB circuit 1901 includes the etching antenna wire 1905, the via 1907, and the antenna microstrip line 1909. The via 1907 is connected to a cable disposed on the backside, so that it has the same effect as the winding of a cable in a spring shape.

The antenna microstrip line is a transmission line and operates like the coaxial cable.

That is, the etching antenna wire 1905, the feed microstrip line 1903, and the antenna microstrip line 1909 correspond to the antenna wire 701, the feeder cable 703, and the coaxial cable 707 illustrated in FIG. 7.

In a case 19-1 where the antenna has one feed point and the antenna microstrip line 1909 is installed at the end of the antenna, the PCB circuit 1901 is connected to the feed microstrip line 1903. The feed microstrip line 1903 is connected to the etching antenna wire 1905, and the etching antenna wire 1905 is connected to the antenna microstrip line 1909. Electric power fed from the feed microstrip line 1903 is transferred up to the antenna microstrip line 1909. The end of the antenna microstrip line 1909 is shorted or opened.

In a case 19-2 where the antenna has one feed point and the antenna microstrip line 1909 is installed at the middle of the antenna, the PCB circuit 1901 is connected to the feed microstrip line 1903. The feed microstrip line 1903 is connected to the etching antenna wire 1905, and the antenna microstrip line 1909 is installed at the middle of the etching antenna wire 1905. Thus, the etching antenna wire 1905 is again installed at the end of the antenna.

In a case 19-3 where the antenna has a plurality of feed points and the antenna microstrip line 1909 is installed at the end of the antenna, the PCB circuit 1901 is connected to the feed microstrip line 1903. Electric power fed from the feed microstrip line 1903 is supplied to one of the etching antenna wire 1905, the first branched etching antenna wire 1911, and the second branched etching antenna wire 1913 according to a control signal. Like in FIG. 19-2, the end of the antenna microstrip line 1909 is shorted or opened.

When the monopole antenna is implemented on the PCB in the above-mentioned methods, its manufacturing cost can be reduced and it is advantageous to mass production.

As described above, the small-sized monopole antennas illustrated in FIGS. 3 to 19 can be implemented in a size less than $\lambda/4$, or can be implemented in a height less than $\lambda/8$ from the ground plane. The small-sized monopole antenna in accordance with the embodiments of the present invention can be applied to whip antennas, helical antennas, sleeve antennas, N-type antennas, or the like.

The small-sized antennas in accordance with the embodiments of the present invention can generate a plurality of resonant frequencies, have high antenna efficiency, are easy to install, and can be implemented in a size less than $\lambda/4$.

As described above, the technology of the present invention can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to certain preferred embodiments, it will be apparent to those skilled in the art that various changes and modifications may be made without departing from the scope of the invention as defined in the following claims.

What is claimed is:

1. A communication antenna, comprising:

a first antenna element formed of a helical coaxial cable that forms a helical antenna with a first resonance frequency; and a second antenna element forming a cavity that the helical coaxial cable is disposed within, the second antenna element and the first antenna element sharing a feed point for receiving electrical power from a feed cable, the second antenna element forming a second resonance frequency different than the first resonance frequency.

2. The communication antenna of claim 1, wherein the first antenna element and the second antenna element have a plurality of electric lengths such that the communication antenna has a plurality of resonant frequencies.

3. The communication antenna of claim 1, wherein the communication antenna is a monopole antenna formed in a size less than $\lambda/4$.

4. The communication antenna of claim 3, wherein the monopole antenna is formed in a size less than $\lambda/8$ from a ground plane.

5. The communication antenna of claim 1, wherein an electrical length of the first antenna element is longer than an electrical length of the second antenna element.

6. A communication antenna, comprising:

a first antenna element formed of a coaxial cable;

a second antenna element serially connected to the first antenna element and formed of a conductive cable;

a first branched etching antenna wire connected to a first position of the second antenna element;

a second branched etching antenna wire connected to a second position of the second antenna element that is different than the first position; and an RF switch for controlling, according to a control signal, selective feeding of an electric power from a feed cable to a third position of the second antenna element that is different from each of the first and second positions, the first branched etching antenna wire, and the second branched etching antenna wire.

7. The communication antenna of claim 6, wherein the first antenna element and the second antenna element have a plurality of electric lengths such that the communication antenna has a plurality of resonant frequencies.

8. The communication antenna of claim 6, wherein the communication antenna is a monopole antenna formed in a size less than λ/4.

9. The communication antenna of claim 8, wherein the monopole antenna is formed in a size less than λ/8 from a ground plane.

10. The communication antenna of claim 6, further comprising a dielectric substance enclosing the first antenna element and the second antenna element.

11. The communication antenna of claim 6, wherein the first antenna element and the second antenna element are helical antennas.

12. A communication antenna, comprising:

a first antenna element in a form of a microstrip line on a board;

a second antenna element serially connected to the first antenna element and in a form of an etching wire on the board;

a first branched etching antenna wire connected to a first position of the second antenna element;

a second branched etching antenna wire connected to a second position of the second antenna element that is different than the first position;

a feed cable for selectively feeding electric power to a third position of the second antenna element that is different from each of the first and second positions, the first branched etching antenna wire, and the second branched etching antenna wire; and an RF switch that controls, according to a control signal, the selective feeding of the electric power from the feed cable to the third position, the first branched etching antenna wire and the second branched etching antenna wire.

13. The communication antenna of claim 12, wherein the first antenna element and the second antenna element have a plurality of electric lengths such that the communication antenna has a plurality of resonant frequencies.

14. The communication antenna of claim 12, wherein the communication antenna is a monopole antenna formed in a size less than λ/4.

15. The communication antenna of claim 14, wherein the monopole antenna is formed in a size less than λ/8 from a ground plane.

16. The communication antenna of claim 12, wherein the feed cable includes a plurality of feed cable elements connected to arbitrary positions of the second antenna element.

17. The communication antenna of claim 12, further comprising a third antenna element serially connected to one end of the first antenna element, another end of the first antenna element being connected to the second antenna element, and the third antenna element being in a form of an etching wire on the board.

18. A communication antenna, comprising:

a first antenna element formed of a coaxial cable;

a second antenna element serially connected to different positions of the first antenna element and in a form of a wire;

a third antenna element serially connected to one end of the first antenna element, wherein another end of the first antenna element is connected to the second antenna element, and the third antenna element is in a form of an etching wire on a board;

a first branched etching antenna wire connected to a first position of the second antenna element;

a second branched etching antenna wire connected to a second position of the second antenna element that is different than the first position;

a feed cable for selectively feeding electric power to a third position of the second antenna element that is different from each of the first and second positions, the first branched etching antenna wire, and the second branched etching antenna wire; and an RF switch that controls, according to a control signal, the selective feeding of the electric power from the feed cable to the third position, the first branched etching antenna wire and the second branched etching antenna wire.

19. The communication antenna of claim 18, wherein the first antenna element, the second antenna element, and the third antenna element have arbitrary electric lengths such that the communication antenna has a plurality of resonant frequencies.

20. The communication antenna of claim 18, wherein the antenna is a monopole antenna formed in a size less than λ/4.

21. The communication antenna of claim 20, wherein the monopole antenna is formed in a size less than λ/8 from a ground plane.

22. The communication antenna of claim 18, further comprising a dielectric substance enclosing the first antenna element, the second antenna element, and the third antenna element.

23. The communication antenna of claim 18, wherein the first antenna element, the second antenna element and the third antenna element are helical antennas.

* * * * *